US008373635B2

(12) United States Patent
Chen et al.

(10) Patent No.: US 8,373,635 B2
(45) Date of Patent: Feb. 12, 2013

(54) METHOD FOR REDUCING RESONANCE ENERGY OF AN LCD PANEL AND RELATED LCD DEVICE

(75) Inventors: Chien-Yu Chen, Hsinchu County (TW); Chen-Jung Chuang, Hsinchu (TW); Ming-Chieh Lin, Hsinchu County (TW); Wen-Hsin Cheng, Hsinchu (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 645 days.

(21) Appl. No.: 12/563,167

(22) Filed: Sep. 21, 2009

(65) Prior Publication Data

US 2010/0271294 A1 Oct. 28, 2010

(30) Foreign Application Priority Data

Apr. 27, 2009 (TW) ..... 98113937 A

(51) Int. Cl.
*G09G 3/36* (2006.01)

(52) U.S. Cl. ..... 345/99; 369/87

(58) Field of Classification Search ..... None
See application file for complete search history.

(56) References Cited

U.S. PATENT DOCUMENTS

| | | | | |
|---|---|---|---|---|
| 2003/0076289 | A1 * | 4/2003 | Tokonami et al. | 345/100 |
| 2008/0316158 | A1 * | 12/2008 | Chang et al. | 345/92 |
| 2009/0135171 | A1 * | 5/2009 | Chen et al. | 345/211 |
| 2010/0079437 | A1 * | 4/2010 | Tonomura | 345/211 |
| 2010/0156866 | A1 * | 6/2010 | Yeo et al. | 345/208 |

* cited by examiner

*Primary Examiner* — Lixi C Simpson
(74) *Attorney, Agent, or Firm* — Winston Hsu; Scott Margo

(57) ABSTRACT

A method for reducing resonance energy of an LCD panel includes providing a plurality of driving signal patterns, each defining a non-overlap area width of a synchronization signal and a scan-line charging frequency, and determining an order of the plurality of driving signal patterns to modulate driving signals of the LCD panel accordingly.

16 Claims, 8 Drawing Sheets

METHOD FOR REDUCING RESONANCE ENERGY OF AN LCD PANEL AND RELATED LCD DEVICE

BACKGROUND OF THE INVENTION

1. Field of the Invention

The present invention relates to a method for reducing resonance energy of an LCD panel and a related LCD device, and more particularly to, a method for reducing resonance energy of an LCD panel by jittering driving signals of the LCD panel and a related LCD device.

2. Description of the Prior Art

Possessing the advantages of light weight, low electrical consumption, and little radiation contamination, a liquid crystal display (LCD) device has replaced a conventional cathode ray tube (CRT) display. Thus, the LCD device has been widely applied to various information products, such as notebooks, PDAs, TVs, mobile phones, etc.

In the LCD device of the prior art, an alternating signal outputted from a driving circuit, such as a common voltage (VCOM) or a clock signal, has an over-centralized operational frequency, causing resonance generated from all components on the LCD panel. The sever resonance could be heard by human ears. Please refer to FIG. 1, which illustrates that the LCD panel noise is caused by the alternating signal of the driving circuit vibrating the components on the LCD panel.

For example, please refer to FIG. 2 and FIG. 3. FIG. 2 is a schematic diagram of a vertical synchronization signal Vsync and a common voltage signal VCOM according to the prior art. FIG. 3 is a schematic diagram of a horizontal synchronization signal Hsync and a common voltage signal VCOM according to the prior art. As shown in FIG. 2 and FIG. 3, the conventional driving method of the LCD panel generates the driving signals with a fixed non-overlap area width between each frame, a fixed charging time of each scan-line, and a fixed non-overlap area width between each scan-line, which causes the frequency response of the driving signals centralizing at a single frequency on spectrum. If that single frequency is located in the audio frequency range, it may result in the vibration of the components on the LCD panel and generate noise heard by human ears.

In order to avoid the aforementioned noise issue, the prior arts usually tune up the operational frequency of the driving circuit, for example above 20 KHz, to surpass the frequency range that human ears can distinguish. But such method may result in power consumption and other issues.

SUMMARY OF THE INVENTION

It is therefore an objective of the present invention to provide a method for reducing resonance energy of an LCD panel and a related LCD device.

The present invention discloses a method for reducing resonance energy of an LCD panel. The method includes providing a plurality of driving signal patterns, each of the plurality of driving signal patterns defining a non-overlap area width of a synchronization signal and a scan-line charging frequency, and determining an order of the plurality of driving signal patterns to modulate driving signals of the LCD panel according to the order.

The present invention further discloses an LCD device capable of reducing resonance energy of an LCD panel. The LCD device includes an LCD panel, a driving circuit, and a modulation module. The driving circuit is coupled to the LCD panel, and utilized for generating driving signals of the LCD panel. The modulation module is coupled to the driving circuit, and utilized for providing a plurality of driving signal patterns and determining an order of the plurality of driving signal patterns to modulate the driving signals of the LCD panel according to the order. Each of the plurality of driving signal patterns defines a non-overlap area width of a synchronization signal and a scan-line charging frequency.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
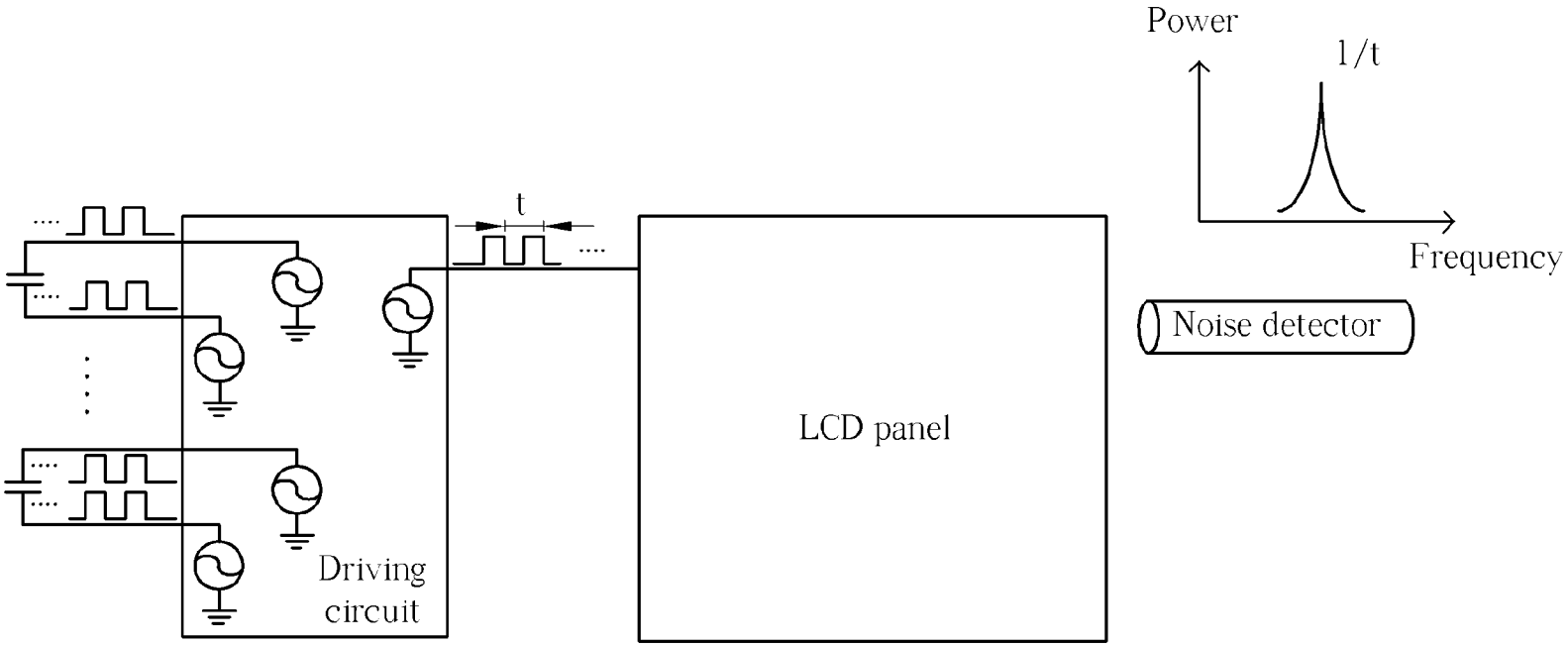
FIG. 1 PRIOR ART
FIG. 1 illustrates that the LCD panel noise is caused by the alternating signal on the driving circuit vibrating the components on the LCD panel.
Figure 2:
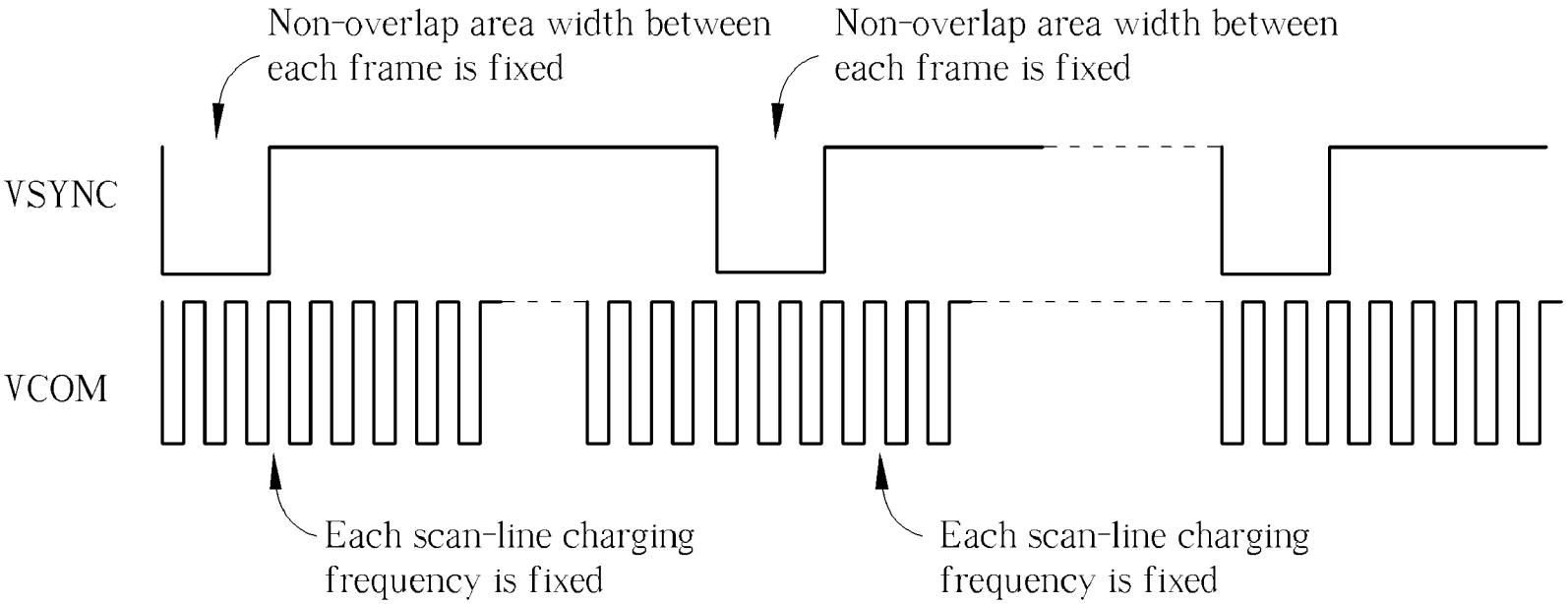
FIG. 2 PRIOR ART
FIG. 2 is a schematic diagram of a vertical synchronization signal and a common voltage signal according to the prior art.
Figure 3:
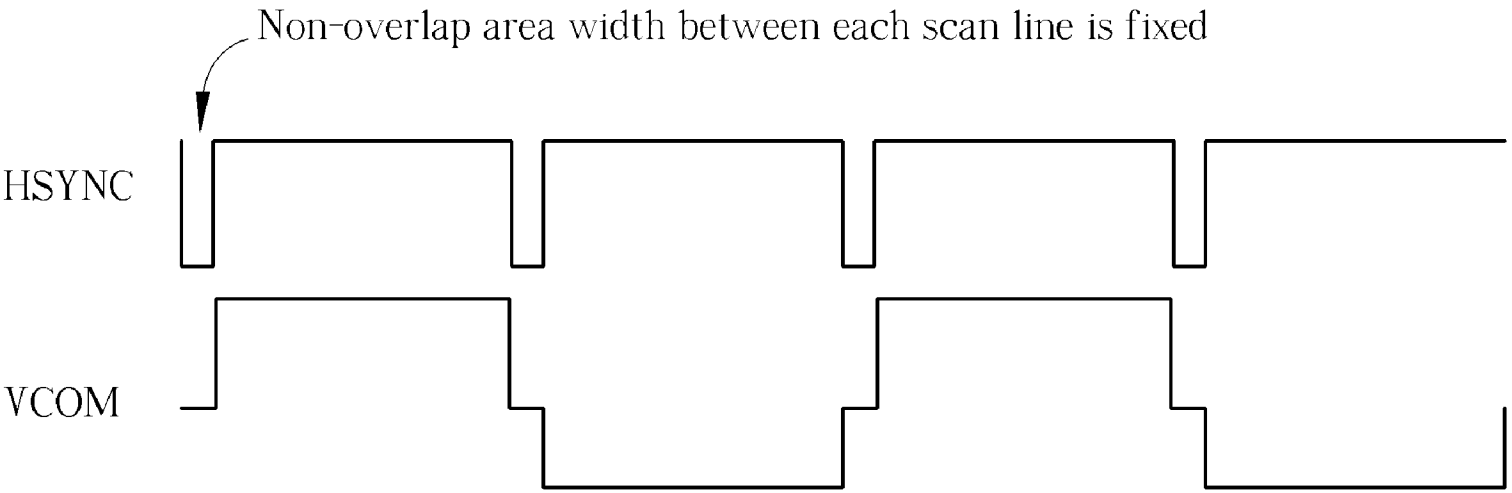
FIG. 3 PRIOR ART
FIG. 3 is a schematic diagrams of a horizontal synchronization signal and a common voltage signal according to the prior art.
Figure 4:
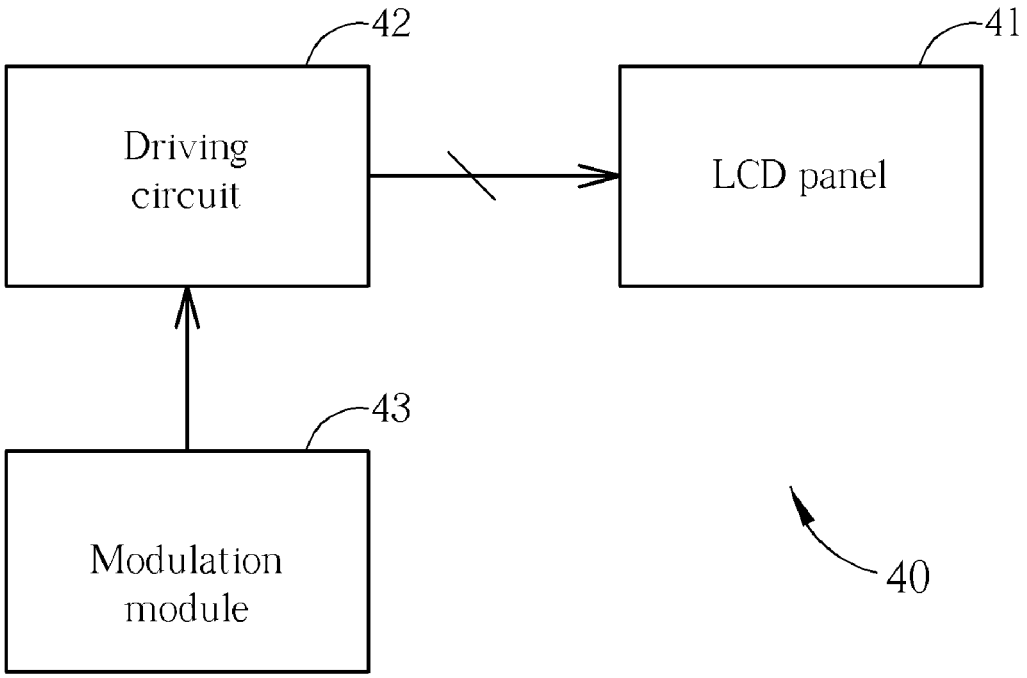
FIG. 4 is a schematic diagram of a liquid crystal display (LCD) device capable of reducing resonance energy according to an embodiment of the present invention.

Please refer to FIG. 4, which is a schematic diagram of a liquid crystal display (LCD) device 40 capable of reducing resonance energy according to an embodiment of the present invention. The LCD device 40 includes an LCD panel 41, a driving circuit 42, and a modulation module 43. The driving circuit 42 is coupled to the LCD panel 41, and utilized for generating driving signals of the LCD panel 41. The modulation module 43 is coupled to the driving circuit 42, and utilized for providing a plurality of driving signal patterns and determining an order of the plurality of driving signal patterns for modulating the driving signals of the LCD panel 41 according to the order. Each driving signal pattern defines a non-overlap area width of a synchronization signal and/or a scan-line charging frequency and is not restricted herein.

Thus, the LCD device 40 of the present invention modulates the alternating signals outputted from the driving circuit 42 to cause jitters in operation frequencies of the driving signal and spread the operational frequency over a wide frequency range, such that resonance energy on the LCD panel can be reduced. The detailed operations of the modulation module 43 can be known by referring to the following statements.

Figure 5:
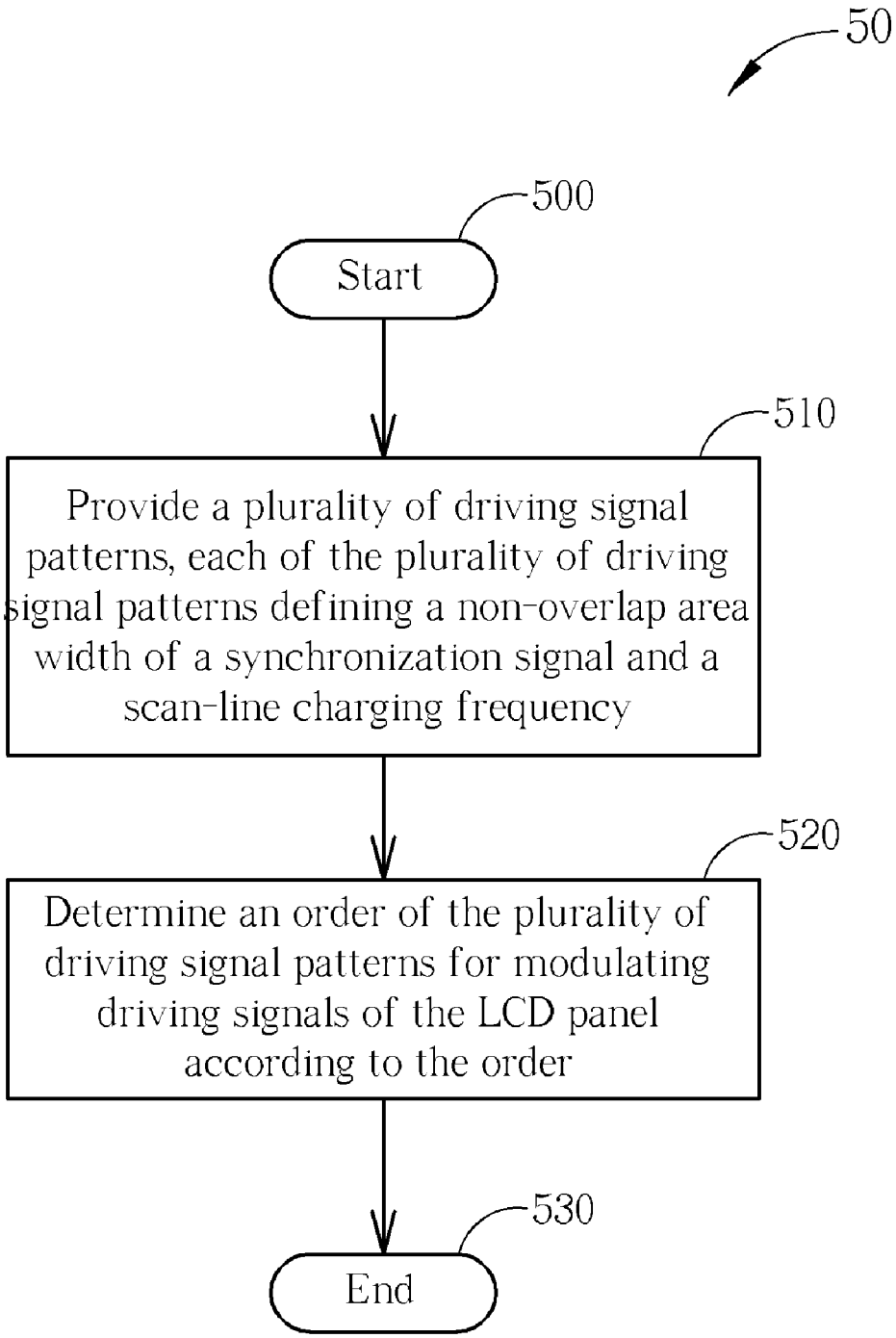
FIG. 5 is a flow chart of a process for reducing resonance energy of an LCD panel according to an embodiment of the present invention.

Please refer to FIG. 5, which is a flow chart of a process 50 for reducing resonance energy of an LCD panel according to an embodiment of the present invention. The process 50 is an operation flow of the modulation module 43 and includes the following steps.

Step 500: Start.

Step 510: Provide a plurality of driving signal patterns, each of the plurality of driving signal patterns defining a non-overlap area width of a synchronization signal and a scan-line charging frequency.

Step 520: Determine an order of the plurality of driving signal patterns for modulating driving signals of the LCD panel according to the order.

Step 530: End.

According to the process 50, the embodiment of the present invention provides the plurality of driving signal patterns. Each driving signal pattern defines a non-overlap area width of the synchronization signal and a scan-line charging frequency. Subsequently, the modulation module 43 determines the order of the driving signal patterns to modulate the driving signals of the LCD panel 41. Consequently, the operation frequencies of the driving signal are spread over a wide frequency range for reducing resonance energy.

Preferably, the aforementioned synchronization signal could be a vertical or horizontal synchronization signal. If the synchronization signal is the vertical synchronization signal, the non-overlap area width of the aforementioned synchronization signal represents a blanking period or a flyback period between each frame. If the synchronization signal is the horizontal synchronization signal, the non-overlap area width of the aforementioned synchronization signal represents a blanking period or a flyback period between each horizontal scan line. Furthermore, in the embodiment of the present invention, the non-overlap area width of the synchronization signal corresponds to an amount of clocks included in the non-overlap area of the synchronization signal, and the scan-line charging frequency corresponds to a polarity inverting frequency of a common voltage of the LCD panel.

Figure 6:
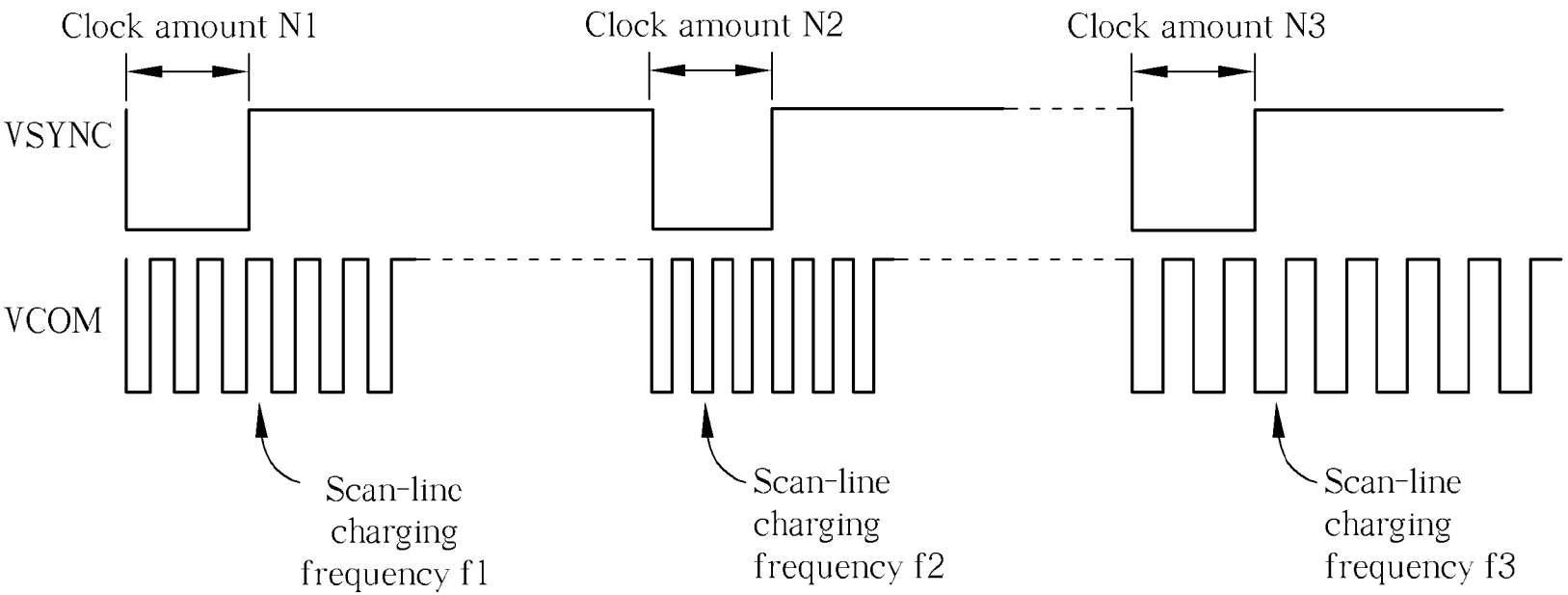
FIG. 6 is a schematic diagram of a vertical synchronization signal and a common voltage according to an embodiment of the present invention.

Please refer to FIG. 6, which is a schematic diagram of a vertical synchronization signal Vsync and a common voltage VCOM according to an embodiment of the present invention. As shown in FIG. 6, the embodiment of the present invention can dynamically modulate the non-overlap area width of the vertical synchronization signal between each frame (e.g. modulating the amount of the clocks included in the non-overlap area of the vertical synchronization signal) and dynamically modulate the scan-line charging frequency of each frame (e.g. modulating the polarity inverting frequency of the common voltage VCOM) in order to reduce the resonance energy, where N1-N3 individually represent the amount of the clocks included in the non-overlap area between each frame and f1-f3 individually represent the scan-line charging frequencies corresponding to each frame.

Figure 7:
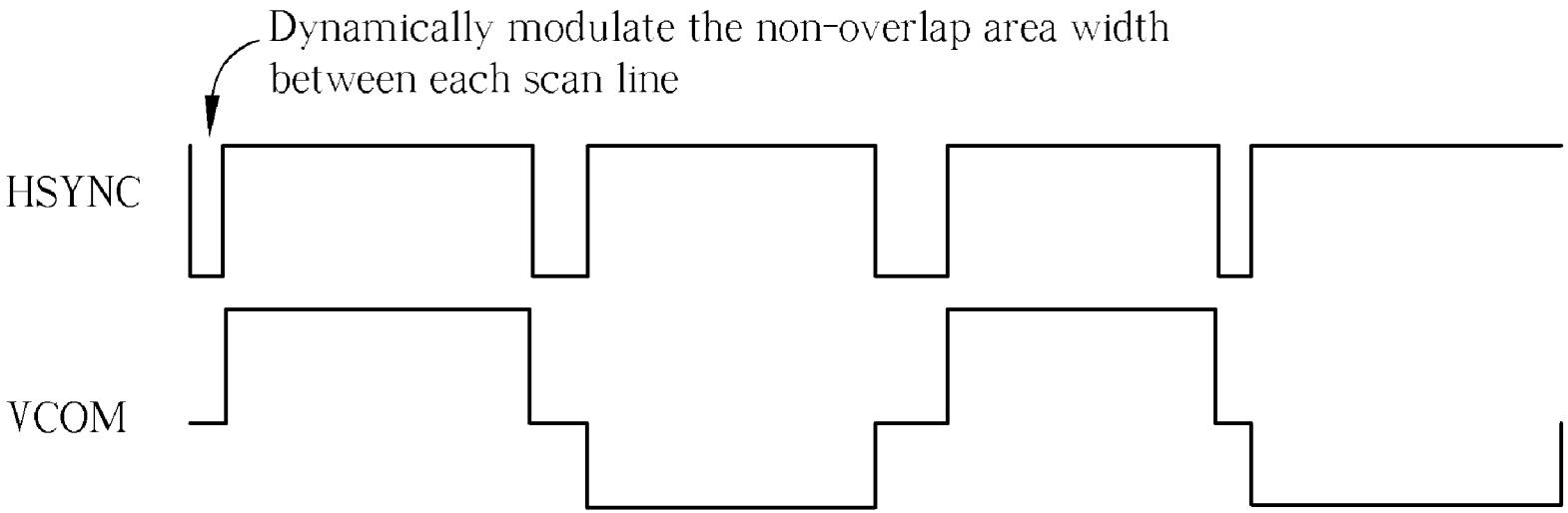
FIG. 7 is a schematic diagram of a horizontal synchronization signal and a common voltage according to an embodiment of the present invention.

On the other hand, please refer to FIG. 7, which is a schematic diagram of a horizontal synchronization signal Hsync and a common voltage VCOM according to an embodiment of the present invention. The embodiment of the present invention can dynamically modulate the non-overlap area width between each scan line (e.g. modulating the amount of the clocks included in the non-overlap area of the horizontal synchronization signal Hsync) to reduce the resonance energy. Certainly, those skilled in the art can modulate any alternating signals of the driving circuit, for example the clock signal, to reduce the resonance energy. Such variations are also included in the scope of the present invention.

Besides, the embodiment of the present invention further permutes the fixed number of driving signal patterns and modulates the driving signals of the LCD panel according to all permutations of the driving signal patterns to avoid deteriorating display quality of the LCD panel due to over-modulation of the driving signals. Please continue to refer to FIG. 6, if the combinations of the clock amounts N1-N3 and the scan-line charging frequencies f1-f3 are defined as driving signal patterns S1-S3, respectively, for example, the clock amount N1 combining with the scan-line charging frequency f1 as a first pattern S1, the clock amount N2 combining with the scan-line charging frequency f2 as a second pattern S2, and the clock amount N3 combining with the scan-line charging frequency f3 as a third pattern s3, the embodiment of the present invention can then modulate the vertical synchronization signal Hsync and the common voltage VCOM according to each permutation order of the driving signal patterns such as S1→S2→S3, S3→S2→S1, S2→S1→S3, for example, to prevent the display quality of the LCD panel from being deteriorated due to resonance energy reduction.

Please note that the embodiment of the present invention limits neither the number of the driving signal patterns Sx, nor the permutation order of the driving signal pattern Sx. Therefore, those skilled in the art are free to modulate the driving signals outputted from the driving circuit 42 by setting the desired patterns and combinations. Such variations are also included in the scope of the present invention. For example, a circuit designer can define the amount of the clocks as N1-Ny and the scan-line charging frequencies as f1-fz. As a result, there are y*z combinations for the driving signal patterns Sx. The combinations of the driving signal patterns Sx can be permuted in any order to modulate the driving signals such that energy of the driving signals can be spread more uniformly on spectrum.

Figure 8:
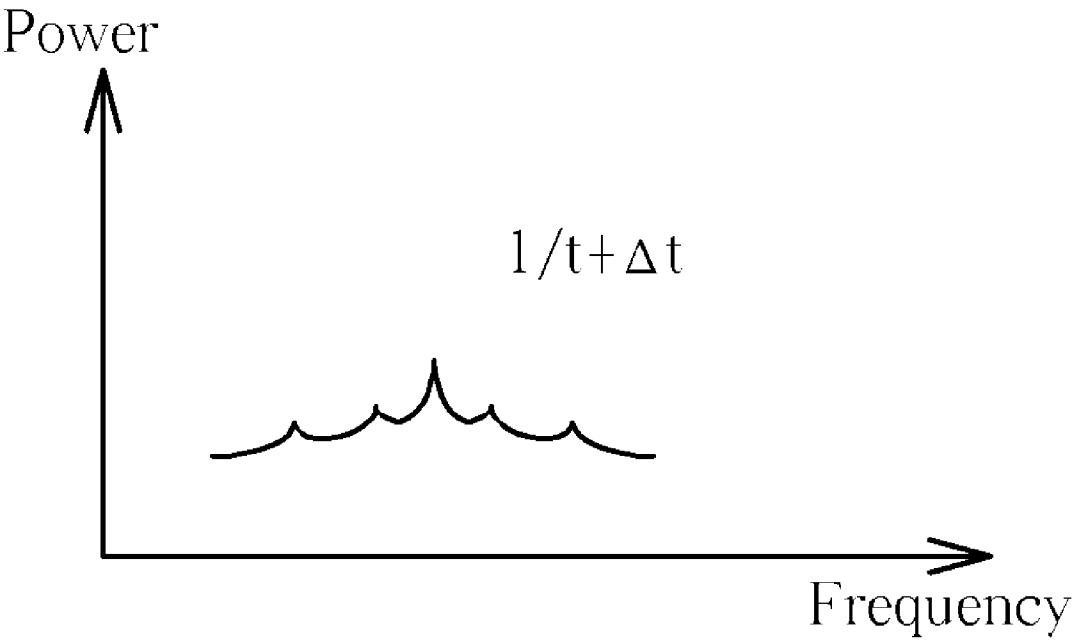
FIG. 8 is a schematic diagram of a frequency response according to an embodiment of the present invention.

Please refer to FIG. 8, which is a schematic diagram of a frequency response according to an embodiment of the present invention. As shown in FIG. 8, the embodiment of the present invention effectively spread the operation frequencies of the driving signals over a wide range to achieve the resonance energy reduction.

To sum up, the embodiment of the present invention modulates the driving signals outputted from the driving circuit to spread the operation frequencies of the driving signals over a wide range, such that the resonance energy on the LCD panel can be reduced.

Those skilled in the art will readily observe that numerous modifications and alterations of the device and method may be made while retaining the teachings of the invention.

What is claimed is:

1. A method for reducing resonance energy of a liquid crystal display (LCD) panel, the method comprising:

providing a plurality of driving signal patterns, each of the plurality of driving signal patterns defining a non-overlap area width of a synchronization signal and a scan-line charging frequency; and determining an order of the plurality of driving signal patterns for modulating driving signals of the LCD panel according to the order.

2. The method of claim 1, wherein the non-overlap area width of the synchronization signal corresponds to an amount of clocks included in the non-overlap area of the synchronization signal.

3. The method of claim 1, wherein the synchronization signal is a vertical synchronization signal and the non-overlap area of the synchronization signal corresponds to a blanking period or a flyback period between each frame.

4. The method of claim 1, wherein the synchronization signal is a horizontal synchronization signal and the non-overlap area of the synchronization signal corresponds to a blanking period or a flyback period between each scan line.

5. The method of claim 1, wherein the scan-line charging frequency corresponds to a polarity inverting frequency of a common voltage of the LCD panel.

6. A liquid crystal display (LCD) device capable of reducing resonance energy of an LCD panel, the LCD device comprising:

an LCD panel;

a driving circuit, coupled to the LCD panel, for generating driving signals of the LCD panel; and a modulation module, coupled to the driving circuit, for providing a plurality of driving signal patterns and determining an order of the plurality of driving signal patterns for modulating the driving signals of the LCD panel according to the order, each of the plurality of driving signal patterns defining a non-overlap area width of a synchronization signal and a scan-line charging frequency.

7. The LCD device of claim 6, wherein the non-overlap area width of the synchronization signal corresponds to an amount of clocks included in the non-overlap area of the synchronization signal.

8. The LCD device of claim 6, wherein the synchronization signal is a vertical synchronization signal and the non-overlap area of the synchronization signal corresponds to a blanking period or a flyback period between each frame.

9. The LCD device of claim 6, wherein the synchronization signal is a horizontal synchronization signal and the non-overlap area of the synchronization signal corresponds to a blanking period or a flyback period between each scan line.

10. The LCD device of claim 6, wherein the scan-line charging frequency corresponds to a polarity inverting frequency of a common voltage of the LCD panel.

11. A method for reducing resonance energy of a liquid crystal display (LCD) panel, the method comprising:

providing a plurality of driving signal patterns, each of the plurality of driving signal patterns defining a non-overlap area width of a synchronization signal; and determining an order of the plurality of driving signal patterns for modulating driving signals of the LCD panel according to the order.

12. The method of claim 11, wherein the non-overlap area width of the synchronization signal corresponds to an amount of clocks included in the non-overlap area of the synchronization signal.

13. The method of claim 11, wherein the synchronization signal is a vertical synchronization signal and the non-overlap area of the synchronization signal corresponds to a blanking period or a flyback period between each frame.

14. The method of claim 11, wherein the synchronization signal is a horizontal synchronization signal and the non-overlap area of the synchronization signal corresponds to a blanking period or a flyback period between each scan line.

15. A method for reducing resonance energy of a liquid crystal display (LCD) panel, the method comprising:

providing a plurality of driving signal patterns, each of the plurality of driving signal patterns defining a scan-line charging frequency; and determining an order of the plurality of driving signal patterns for modulating driving signals of the LCD panel according to the order.

16. The method of claim 15, wherein the scan-line charging frequency corresponds to a polarity inverting frequency of a common voltage of the LCD panel.

* * * * *